United States Patent [19]

Herper et al.

[11] 4,270,129

[45] May 26, 1981

[54] APPARATUS AND METHOD FOR REALIZING PRESELECTED FREE SPACE ANTENNA PATTERNS

[75] Inventors: John C. Herper, Glen Cove; John J. Stangel, Mahopac, both of N.Y.

[73] Assignee: Sperry Corporation, New York, N.Y.

[21] Appl. No.: 7,759

[22] Filed: Jan. 30, 1979

[51] Int. Cl.[3] ..... H01Q 1/28

[52] U.S. Cl. ..... 343/703; 343/753; 343/755

[58] Field of Search ..... 343/753, 755, 754, 703

[56] References Cited

U.S. PATENT DOCUMENTS 3,456,260 7/1969 Hannan ..... 343/755

*Primary Examiner*—David K. Moore

*Attorney, Agent, or Firm*—Howard P. Terry; Seymour Levine

[57] ABSTRACT

An antenna and a method for obtaining predetermined far field antenna patterns is disclosed. Empirical adjustments of a focal region feed system provides for the compensation of tolerance or other imperfections of the antenna to achieve the desired far field pattern. An element of the feed system is adjusted when the antenna is angularly positioned, with respect to a receiving element in the far field, which corresponds to the location of the element in the feed array. A desired far field pattern may also be achieved by illuminating the antenna aperture, either simultaneously or sequentially, by several plane waves, the amplitude and incident angles of which are carefully controlled, measuring the phase and amplitude of the focal region distribution caused by this illumination, and designing the feed system to establish a focal region distribution that is the complex conjugate of that measured.

2 Claims, 3 Drawing Figures

APPARATUS AND METHOD FOR REALIZING PRESELECTED FREE SPACE ANTENNA PATTERNS

BACKGROUND OF THE INVENTION

1. Field of the Invention

The invention pertains to antenna pattern synthesis and more particularly to apparatus and method for obtaining a focal region feed distribution for realizing selected free space antenna patterns.

2. Description of the Prior Art

The far field pattern and the aperture field distribution of an antenna are Fourier transform pairs when the field in the aperture plane outside the aperture bounds is zero. This permits the pattern produced by an aperture to be readily analyzed. Pattern synthesis, however, presents a much more difficult problem. In practice, the far field pattern is generally specified only in amplitude and as a consequence thereof, the aperture distribution is not uniquely determined; the desired amplitude pattern being realizable from various combinations of amplitude and phase distributions in the aperture. For most high gain antennas, however, the aperture phase is either constant or linearly distributed across the aperture, resulting in radiated beams with linear phase fronts, the beams being directed along the perpendiculars to the linear phase fronts. Thus, for high gain antennas, each radiated pattern may be decomposed into a weighted sum of linear phase front beams, each of which has a linear phase distribution across the aperture, the superposition of amplitude and phase distributions determining the over-all aperture distribution to achieve the desired far field antenna pattern.

Aperture distributions that are uniform in amplitude and phase provide maximum aperture efficiency in that the maximum gain achievable with a given aperture is realized. When the phase distribution is altered from uniform to linear, the effective aperture is decreased becoming equal to the projection in the direction of the radiated beam, which direction is along the perpendicular to the linear phase front. Though uniform amplitude and phase distribution provides maximum aperture efficiency, the ratio of main beam amplitude to the maximum sidelobe amplitude for many applications is inadequate. To improve this ratio, various aperture distributions have been considered each exhibiting its limitations and attributes. The radiation patterns resulting from these distributions are sensitive to aperture phase and amplitude errors, exhibiting beam distortions and sidelobe level deteriorations with deviations from the prescribed aperture values. The minimization of these errors in reflector and lens type antennas requires manufacturing the reflector surfaces and lens elements to tight tolerances which impose a fundamental limitation on the sidelobe levels and significantly increase the cost of the antennas. The sidelobe level limitations may be overcome by constituting the aperture as a planar array of discrete elements and individually adjusting the phase and amplitude at each element by tedious experimental methods.

The present invention discloses an apparatus and method with which desired amplitude and phase distributions may be achieved in antenna apertures in a relatively simple manner with prevailing tolerance conditions.

SUMMARY OF THE INVENTION

When a multiplicity of radiating sources are positioned in the far field of an antenna at equal distances therefrom and at selected angular positions, plane waves which result from these radiations illuminate the aperture at angles of incidence which are equal to the angular positions of the sources and a distribution, which is the vector sum of the incident plane waves, is established across the aperture. This aperture distribution is transformed by the antenna to a focal plane pattern, each point in the focal plane pattern having a corresponding point in the far field pattern. By providing a feed array at the antenna's focal plane and causing each element to radiate a signal that is the complex conjugate of the value at the position of that element of the previously determined focal plane pattern, the previously measured aperture distribution is re-established and the antenna will have a radiation pattern that is equal to that simulated by the multiplicity of far field sources.

In one embodiment of the present invention, a multiplicity of sources, with weighted amplitudes, are symmetrically positioned about the antenna's axis in the far field of the antenna with the angular spacing in radians therebetween substantially equal to $\lambda/D$, D being equal to the dimension of the antenna in the plane of the sources, and $\lambda$ is the wavelength of the radiation. Sin X/X beams radiated from the antenna towards these sources establishes a set of orthogonal beams in space which may be summed to obtain the desired radiation pattern. Each source causes a plane wave to be incident to the antenna aperture with the relative weight and angle of incidence that is equal to the weighting factor and the angular position of the source, creating an aperture distribution consistent with the desired radiation pattern. The focal plane pattern due to the resulting aperture distribution is measured and a feed system is designed to radiate a pattern from the focal plane that is the complex conjugate of that measured.

In another embodiment of the invention, a feed system of an antenna is designed assuming a theoretically perfect antenna. The elements of this feed system are positioned in the focal plane to produce orthogonal Sin X/X pattern functions in free space. Each such element has incorporated therein the capability to adjust the phase and amplitude excitation. A field monitor is located in the far field of the antenna and the antenna is positioned to place the monitor at an angle from which parallel rays incident to the aperture will focus in a sector of the focal region wherein an element of the feed array is located. When this is done, the direction of the field monitor also corresponds to the direction of the peak of the approximate Sin X/X pattern produced by exciting the given feed array element. The phase and amplitude of the excitation from this element are then varied until a signal is monitored that is substantially equal to the desired signal at the radiation angle corresponding to the position of the adjusted element. This procedure is repeated for selected elements in the feed array. When all selected elements have been adjusted, a far field pattern is recorded and a determination is made if another iteration is required. The technique is simple to implement and does not require complex measurement procedures or highly accurate calibrations. Proper adjustments of the elements in the feed array ultimately produce an antenna having a desired far field pattern. This method can produce patterns which sidelobe levels achievable in the prior art only with antennas manufactured to extreme tolerances and a commensurate increase in cost.

DESCRIPTION OF THE PREFERRED EMBODIMENTS

When an antenna is illuminated by a distant transmitter, the resulting incident plane wave establishes a uniform distribution across the antenna's aperture which is focussed to a "spot" in the focal region of the antenna. This "spot" in an aberration free antenna, is the point in the focal region which is the center of the amplitude distribution pattern formed as a result of the focussing, which pattern is a Sin X/X function when the antenna aperture is linear and an Airy function when the antenna aperture is circular. Any antenna imperfections produces aberrated amplitude and phase distributions in the focal region. By probing the phase and amplitude distribution in the focal region when the antenna is illuminated with a plane wave and thereafter providing a feed system in the focal region tailored to establish a distribution therein which is the complex conjugate of the originally measured distribution, a high efficiency radiation pattern may be established. This technique may be improved to provide antenna patterns which are environment and mechanical tolerance sensitive, as for example, antenna patterns exhibiting ultra low sidelobe levels, without altering the environment or incurring the expense of maintaining extremely small manufacturing tolerances.

Figure 1:
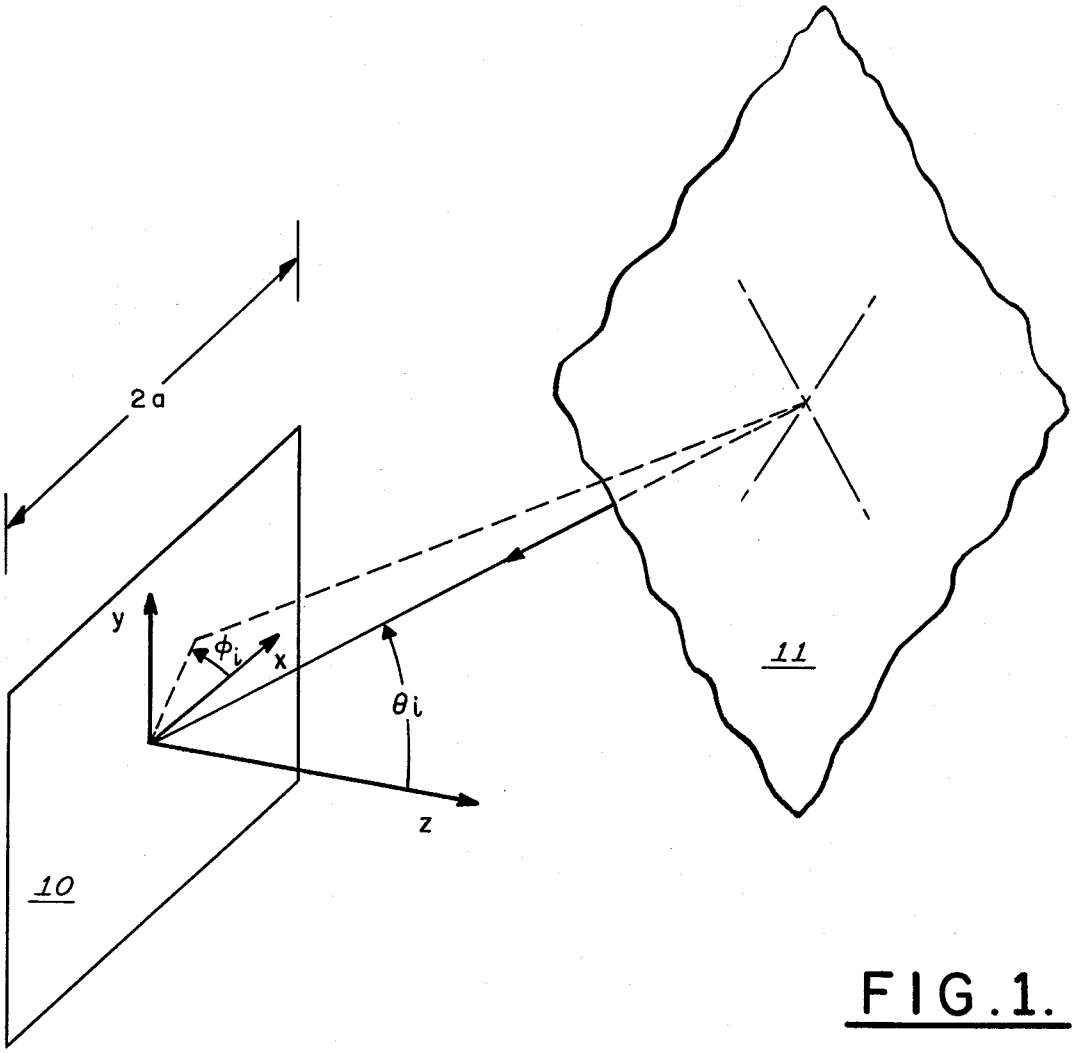
FIG. 1 is a pictorial representation of a plane wave incident to an antenna aperture.
Figure 2:
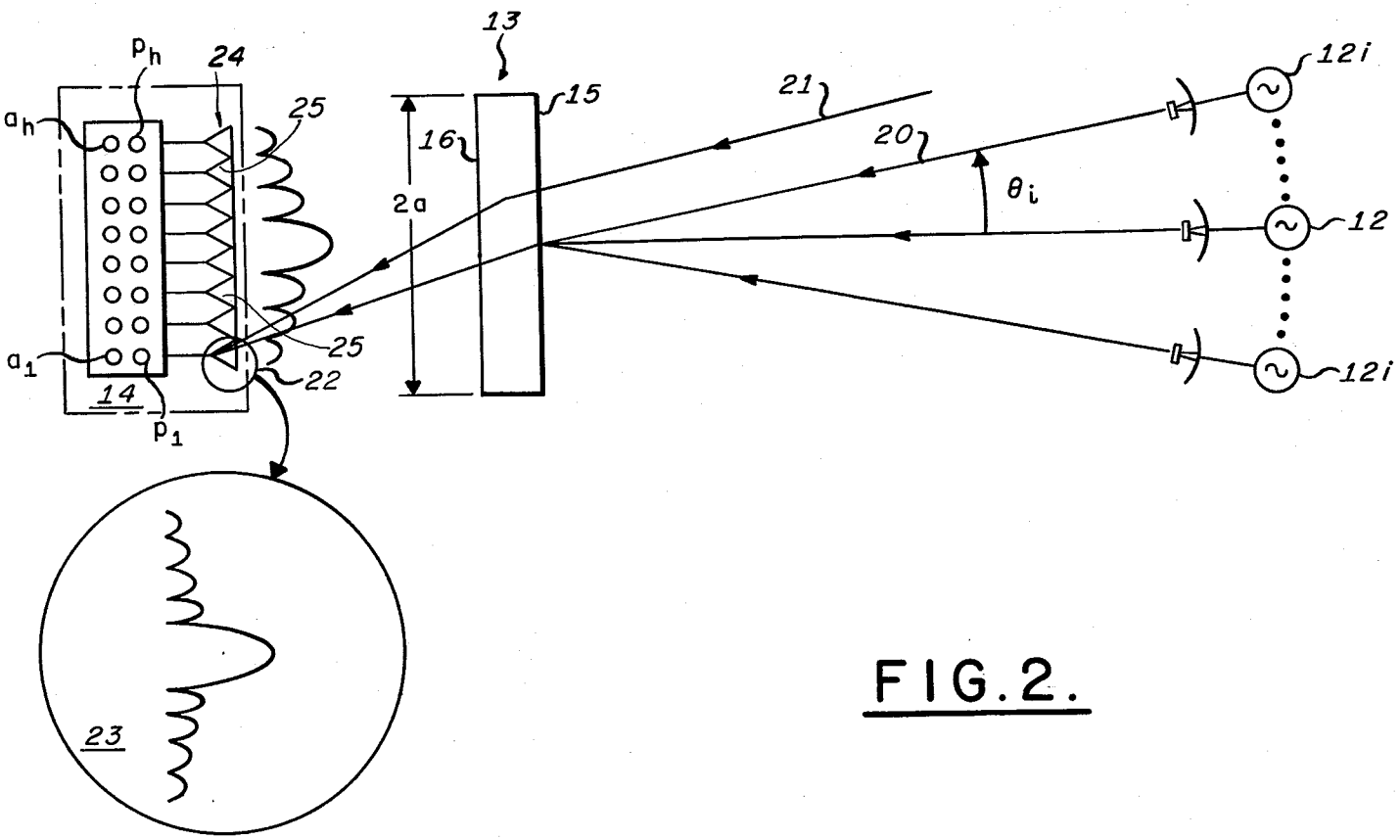
FIG. 2 is a schematic representation of an antenna embodying the principles of the invention.

Refer now to FIG. 1 wherein is shown an aperture 10 with coordinates x, y, and z, having a plane wave 11 incident thereto from a direction that is specified by the angular coordinates $\phi_i$ and $\theta_i$ in the coordinate system of the aperture. For purposes of explanation and simplicity, consider a two dimensional lens system in the x, z plane as shown in FIG. 2. It is well known in the art that a multiplicity of plane waves each with amplitude $C_i$ emanating in phase from sources at equal distances from an antenna aperture which are symmetrically positioned in the x,z plane about the z axis will establish an aperture illumination function f(x) that is given by $$f(x) = \sum_{i=0}^{N} 2\, C_1 \operatorname{Cos}\left(\frac{2\pi}{\lambda} \times \sin\theta_i\right)$$

where λ is the operating wave length of the lens system. If the sources are positioned such that $\sin\theta_i = m\ (\lambda/2a)$, $i = m = 0, 1, 2, \ldots$ or $$\sin\theta_i = \left(\frac{2n-1}{2}\right)(\lambda/2a),$$

$i = n = 1, 2, 3, \ldots$, the functions $$\cos\left(\frac{2\pi}{\lambda} \times \sin\theta_i\right)$$

form orthogonal sets which permit the amplitudes of the incident plane waves, for a specified aperture illumination function (aperture distribution), to be determined from $$C_m = \tfrac{1}{2} \int_{-1}^{1} f(x')\operatorname{Cos}(m\pi x')dx';x' = \frac{x}{a} \tag{1}$$

when $\sin\theta_m = m\,\lambda/2a$ and $$C_n = \tfrac{1}{2} \int_{-1}^{1} f(x')\operatorname{Cos}\left(\frac{2n-1}{2}\pi x'\right) dx';x' = \frac{x}{a} \tag{2}$$

when $\sin\theta_n = \frac{2n-1}{2}\ \frac{\lambda}{2a}$.

Figure 3:
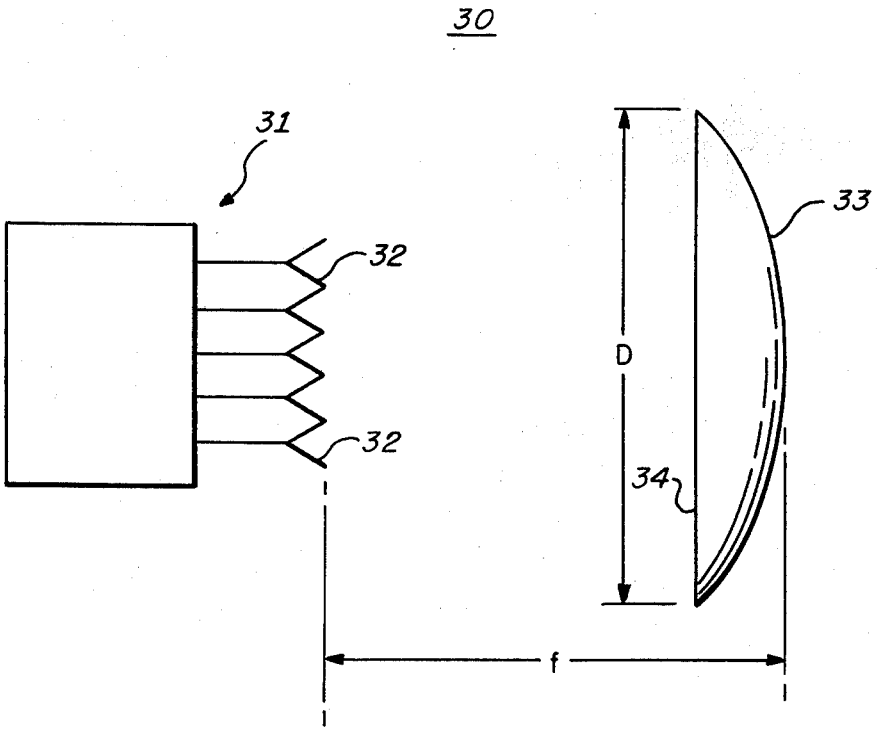
FIG. 3 is a schematic representation of a reflector type antenna embodying the principles of the invention.

A lens system with collimating lens 13 and focal plane feed 14, shown in FIG. 2, is designed to establish equal path lengths from its focal point to the radiating aperture 15. For a perfect lens 13 the complex distribution across the feed illuminated aperture 16, created by a focal region radiation distribution, is transformed by the lens to provide the radiating aperture 15 distribution to establish the desired far field pattern. For an errorless lens the focal region distribution and the far field pattern are identical functions. If the lens introduces errors in transforming the distribution from the feed illuminated aperture 16 to the radiating aperture 15, deviations from the design for far field pattern will be realized. Compensation for these errors may be accomplished by creating a desired aperture distribution in the radiating aperture 15 with far field sources. This distribution is transformed by the lens to a distribution in the feed illuminated aperture 16 to radiate therefrom and establish a focal region distribution. Lens errors cause the focal region distribution so established to deviate from the designed for distribution. The deviated focal region distribution is the distribution, for that lens, which corresponds to the desired far field pattern. Since the lens is lossless and reciprocal, a far field pattern corresponding to the induced aperture distribution may then be radiated by illuminating the focal plane with a distribution that is the complex conjugate of the determined focal plane distribution, the complex conjugate distribution being necessary to compensate for the change in the direction of radiation. For a lossless reciprocal lens, it is also possible to radiate from the focal region feed array 24 and adjust the excitation at selected elements 25 until a desired signal level is achieved at a corresponding angular position in the far field. Repeating these adjustments for all elements 25 in the array will provide a focal region distribution, when the elements 25 are simultaneously excited, which is transformed to the sought after far field radiation pattern. feed systems in a focal region to illuminate a radiating aperture, including the reflector type antenna 30 shown in FIG. 3. Antenna 30 may comprise a feed antenna 31, which may be an array of radiating elements 32, positioned in a focal plane of a reflector 33, which may be parabloid of revolution having a circular aperture 34 of diameter D.

Referring again to FIG. 2, there is shown an antenna utilizing a focal plane feed array feed 24, the positioning of the elements 25 thereof yet to be specified, and a lens 13 which may be one of the types described by Seymour B. Cohn in Chapter 14 of "Antenna Engineering Handbook" edited by Henry Jasik, McGraw Hill Book Company, Inc. 1961. The lens 13 has a radiating aperture 15 of dimension $D=2a$ across which a desired field distribution may be a full cosine on a pedestal. This distribution may be represented by the equation $$f(x')=1+2C_1 \cos \pi x' \quad (3)$$

It is known by those skilled in the art that this distribution will provide a free space radiation pattern with side lobe levels and beamwidth factors that are functions of $C_1$. As for example a value of $C_1$ substantially equal to 0.46 will provide a free space antenna pattern with a maximum side lobe level of substantially 36 dB and a 3 dB beam width in the order of $1.32\lambda/D$. From equation (1), it is apparent that the aperture distribution of equation (3) may be synthesized by three plane waves incident to the aperture in phase. These incident waves may be provided three in phase radiating elements positioned in the far field at equal distances from the aperture; one on the z axis, with the relative radiating amplitude of unity, and two radiating elements symmetrically positioned about the z axis at angles $\nu_1=\pm\sin^{-1}\lambda/2a$, each with relative radiating amplitude $C_1$. These radiating elements establish the desired aperture illumination. The focal region distribution, resulting from the established aperture illumination may be determined by probing the focal region and a feed system may be designed to radiate a focal region distribution which is the complex conjugate of the probe determined distribution. For a lens 13 with a focal length f and aperture dimension D the elements 25 of the feed array 24 in the focal plane of the lens 13 may be positioned with spacing s therebetween substantially equal to $\lambda f/D$.

It will be recognized by those skilled in the art that this spacing should be altered when f/D is greater than unity. It will also be recognized by those skilled in the art that the spacing between elements may vary from the value $\lambda f/D$ provided a close approximation to the desired focal plane distribution is created by the resulting array.

Alternatively the focal region array 24 may be initially designed with spacing s between the elements 25 substantially equal to $\lambda f/D$. As described above, three far field radiating elements may be positioned to establish a desired field distribution across the aperture 15 of the lens 13. A receiving device may then be placed at the output port of an element and matched terminations placed at the output ports of all other elements in the array. The relative phase and amplitude at the port of the element with the receiving device may then be measured in a manner well known in the art. This procedure may then be repeated for each element in the array until the relative amplitude and phase is determined for all elements in the array, thus establishing the received focal plane distribution for the illuminated aperture distribution. A feed system for the focal array 24 may then be designed to couple a signal to the port of each element 22 of the array 24 that is the complex conjugate of relative amplitude and phase measured at the element by the procedure described above. The focal region distribution provided by a feed system designed in the manner described above compensates for any inherent antenna errors and establishes a distribution across the radiating aperture of the antenna that is the complex conjugate of that synthesized by the far field radiating elements.

From the above it should be obvious that a focal region distribution computed for an errorless antenna system will generate a distorted aperture distribution when errors exist in the intervening components between the focal region and the aperture and concomitantly results in a distorted far field pattern. Conversely, if the focal region field distribution is distorted in a manner to compensate for the errors in the intervening components, an errorless aperture distribution will result and a concomitant errorless far field pattern will be realized.

As stated previously, the far field pattern and the focal region distribution of an idealized antenna system are identical functions. It therefore follows that points in the focal region are related to discrete points in the far field and all parallel rays such as 20 and 21 representative of an incident plane wave from a specific direction in space will all focus to a common sector 22 in the focal region and generate a Sin X/X pattern therein, as illustrated in the exploded view 23 of the focal region 22. The position of the $i^{th}$ element in the array 25, which corresponds to the $i^{th}$ discrete point in the far field may be determined from the focal length of the lens 13 and the angle made by the normal to the lens at the center thereof and the line drawn between the center of the lens 13 and the discrete point in the far field. For example, the element position within the focal region 22 corresponding to a point in the far field located at an angle $\theta_i$, with respect to the normal to the aperture, is f tan $\theta_i$, which for $\theta_i$ small is substantially given by $f\theta_i$. For selected locations in the far field that are at angles $\theta_i$ relative to the normal to the aperture 15 substantially equal to $i\lambda/D$, the positioning of the elements of the array 25 in the focal region is substantially equal to $i\lambda f/D$, with spacings therebetween substantially equal to $f\lambda/D$. Conversely, if the sector in the focal region is uniformly excited, a Sin X/X pattern will result in the far field centered about the direction of the corresponding plane wave. When the lens errors are taken into consideration, the resultant pattern from a uniformly excited focal sector or from a plane wave illumination deviates from the Sin X/X pattern in accordance with the lens error function. Consequently, radiating elements of the feed system may be located at focal region sectors which correspond to selected orthogonal plane wave directions. The $\lambda/2a$ spacing of these directions establish spatial frequency sampling points of the free space pattern at which the field samplings completely determine the far field pattern. Because of the orthogonal relationship between the individual plane waves, the individual contributions to the far field by the radiating elements of the feed system are substantially independent. Therefore, adjusting the phase and amplitude of a feed element will principally affect the far field pattern in the direction of the corresponding plane wave and not at the other sample points. By monitoring the far field at a point corresponding to an orthogonal direction represented by a feed element, the excitation of that element can be varied until the field value at that point is the desired value for the errorless pattern. Varying this excitation will have minimal effect on the field at points in the other orthogonal directions. Therefore, independent sequential adjustment of the field in different orthogonal directions represents a practical process which will rapidly converge to the ideal pattern with a minimum number of iterations.

This method of establishing the far field pattern of an antenna may be implemented by incorporating the ability to adjust the phase and amplitude of the excitation of each element of the feed array in the feed network design. As an example of this procedure, consider the lens antenna system of FIG. 2. The elements 25 of the array 24 are positioned therein at locations in the focal region of lens 13 corresponding to the selective orthogonal plane wave directions, resulting in a spacing between the elements 25 that are substantially equal to $\lambda f/D$, f being the focal length of the lens 13, $D=2a$ the dimension of the lens aperture in the plane interest, and $\lambda$ being the operating frequency of the antenna system. If f/D is greater than unity and the feed element 25 beam width is sufficiently broad to permit spillover, the spatial frequency sampling points must be chosen so that the spacing between elements is less than a wave length $\lambda$ to prevent such spillover due to the formation of grating lobes. Initially, the amplitude and phase settings at the ports of the elements 25, which may be controlled by control knobs $a_1$ through $a_n$ and $p_1$ through $p_n$, respectively, may be set for an errorless feed excitation. A single antenna and detecting device maybe located in the far field and the antenna under test rotated until the far field antenna is positioned at an angle corresponding to an element in the feed array. The phase and amplitude of this element are then varied until the desired pattern value is detected at the far field antenna. The antenna is then rotated to position the far field antenna at an angle corresponding to a second element in the feed array. The phase and amplitude of this second element is then adjusted until the desired pattern value for that angular position is detected in the far field of the antenna as for example, elements corresponding to null positions are adjusted to generate a null or minimum in the corresponding direction. This procedure is repeated for each element in the feed array selected for adjustment. When all selected elements are adjusted, a far field pattern is recorded from which it is determined if another iteration is required.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A method of achieving a desired far field pattern for an antenna having a focal region and a feed system with a feed antenna aperture in the focal region comprising the steps of:

positioning elements of said feed antenna at selected focal sectors of said focal region each of which correspond to a plane wave incident to the aperture of said antenna from a selected angular position such that $\sin \theta_n$ is substantially equal to $$\frac{2n-1}{2}\lambda/D$$

where $\theta_n$ in said angular position, n is an integer, $\lambda$ is the operating wavelength of said antenna, and D the aperture dimension of said antenna;

locating detecting means in the far field of said antenna;

rotating said antenna such that said detecting means is angularly positioned relative to said antenna at one of said selected angular positions; ;p1 detecting radiation from said antenna at said detecting means; and adjusting the phase and amplitude of the excitation from the element in said feed system corresponding to said selected angle of incidence at which said detecting means is located to achieve a signal level at said detecting means that is substantially equal to the relative signal level of the desired antenna pattern at the angular position of said detector.

2. A method of achieving a desired far field pattern for an antenna having a focal region and a feed system with a feed antenna aperture in the focal region comprising the steps of:

positioning elements of said feed antenna at selected focal sectors of said focal region each of which correspond to a plane wave incident to the aperture of said antenna from a selected angular position such that $\sin \theta_m$ is substantially $m\lambda/D$, where $\theta_m$ is said angular position, m is an integer, $\lambda$ is the radiation wavelength of said antenna and D is the aperture dimension of said antenna;

locating detecting means in the far field of said antenna;

rotating said antenna such that said detecting means is angularly positioned relative to said antenna at one of said selected angular positions;

detecting radiation from said antenna at said detecting means; and adjusting the phase and amplitude of the excitation from the element in said feed system corresponding to said selected angle of incidence at which said detecting means is located to achieve a signal level at said detecting means that is substantially equal to the relative signal level of the desired antenna pattern at the angular position of said detector.

* * * * *